US011339975B2

(12) United States Patent
Braden et al.

(10) Patent No.: US 11,339,975 B2
(45) Date of Patent: May 24, 2022

(54) EXHAUST GAS MIXING FLUE FOR GAS APPLIANCE

(71) Applicants: BSH Home Appliances Corporation, Irvine, CA (US); BSH Hausgeräte GmbH, Munich (DE)

(72) Inventors: Ben Braden, Lafollette, TN (US); Ian McIver, Knoxville, TN (US); Richard Moyers, Morristown, TN (US); Charles Osborne, Speedwell, TN (US); Rose Marie Parker, Caryville, TN (US); Timothy Russell, Jacksboro, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 74 days.

(21) Appl. No.: 16/792,335

(22) Filed: Feb. 17, 2020

(65) Prior Publication Data

US 2021/0254837 A1 Aug. 19, 2021

(51) Int. Cl.
*F24C 15/20* (2006.01)
*F24C 3/08* (2006.01)

(52) U.S. Cl.
CPC ..... *F24C 15/2007* (2013.01); *F24C 3/08* (2013.01)

(58) Field of Classification Search
CPC ..... F24C 15/2007
See application file for complete search history.

(56) References Cited

U.S. PATENT DOCUMENTS

| | | | | |
|---|---|---|---|---|
| 2,743,719 | A * | 5/1956 | Reeves | F24C 15/001 126/299 R |
| 3,499,430 | A | 3/1970 | Kemp | |
| 4,598,691 | A * | 7/1986 | Herrelko | F24C 15/2007 126/19 R |
| 4,763,638 | A | 8/1988 | Hurley et al. | |
| 5,158,065 | A | 10/1992 | Lee et al. | |
| 7,923,663 | B2 | 4/2011 | Kim et al. | |
| 2011/0132346 | A1 | 6/2011 | Sakane et al. | |
| 2016/0178218 | A1* | 6/2016 | Kulemin | F24C 15/001 126/21 R |

* cited by examiner

*Primary Examiner* — Jason Lau
(74) *Attorney, Agent, or Firm* — Michael E. Tschupp; Andre Pallapies; Brandon G. Braun

(57) ABSTRACT

A domestic cooking appliance includes: a main housing; a cooking compartment; a gas burner that provides heat to the cooking compartment; a cooling air passageway located between the cooking compartment and a rear wall of the main housing, the cooling air passageway being separated from the cooking compartment by a rear wall of the cooking compartment; and a gas flue. The gas flue has an exhaust gas inlet open to the cooking chamber, the exhaust inlet being located in a lower panel of the gas flue, a cooling air inlet open to the cooling air passageway, an outlet located above the exhaust gas inlet, above the cooling air inlet, and above an uppermost portion of the cooking compartment, and an upper deflector located above the outlet and angled relative to vertical at a non-zero first angle such that the upper deflector extends over at least a portion of the outlet.

11 Claims, 7 Drawing Sheets

EXHAUST GAS MIXING FLUE FOR GAS APPLIANCE

FIELD OF THE INVENTION

The invention is directed to a domestic cooking appliance. More particularly, embodiments of the invention are directed to a cooking appliance having a heating compartment that is heated by a gas burner.

An example of an application for the invention is a domestic kitchen gas oven having a flue that combines combustion gases from a gas burner with cooler air that circulates outside of the heating compartment. Examples of the invention direct the combined combustion gases and air toward a front of the oven from an upper, rear area of the oven.

BACKGROUND OF THE INVENTION

Some modern domestic kitchens include cooking appliances such as ovens and ranges that have a gas burner located in the bottom of a cooking compartment. Many of these cooking appliances produce exhaust gases that must be vented to a location outside of the appliance.

Applicants recognized an improvement to the above arrangement and implement that improvement in embodiments of the invention.

SUMMARY

The invention achieves the benefit of improving venting of exhaust gases in a gas cooking appliance by providing a flue arrangement that efficiently vents the exhaust gases and cools them in the process.

Some cooking appliances use ducts or flues to create a pathway for exhaust gases so that the exhaust gases are vented to a location outside of the appliance. Many of these duct arrangements transmit heat from the exhaust gases to areas inside and/or outside of the appliance. Many areas inside and outside of the appliance should not be subjected to temperatures above a certain level. Various regulations dictate maximum allowable temperatures at various locations outside of an appliance.

A properly designed flue is important to the cooking performance of a gas cooking appliance. Embodiments of the invention provide a flue that exhausts combustion gases from the cooking compartment of the gas cooking appliance so that the gas burner(s) function properly. Embodiments of the invention reduce the temperatures experienced by a wall behind the appliance (the back wall), create a more controlled cooking experience, and to help facilitate better burner combustion.

Embodiments of the invention improve on other flue designs by integrating cool air into the stream of hot exhaust air, directing the exhaust that exits the flue at a specific angle which directs it away from the rear wall, and including important internal angles which help to guide the exhaust up and out of the flue and further increase performance.

The invention provides an improvement to gas cooking appliances by providing a gas flue that efficiently mixes hot exhaust gases with cooler air to reduce the temperature of the gas/air mixture that exits the appliance.

Particular embodiments of the invention are directed to a domestic cooking appliance for heating a food item. The domestic cooking appliance includes: a main housing having a rear wall; a cooking compartment in the main housing, the cooking compartment being configured to receive the food item to be heated; a gas burner that provides heat to the cooking compartment; a cooling air passageway located between the cooking compartment and the rear wall of the main housing, the cooling air passageway being separated from the cooking compartment by a rear wall of the cooking compartment; and a gas flue having an exhaust gas inlet open to the cooking chamber, the exhaust inlet being located in a lower panel of the gas flue, a cooling air inlet open to the cooling air passageway, an outlet located above the exhaust gas inlet, above the cooling air inlet, and above an uppermost portion of the cooking compartment, and an upper deflector located above the outlet and angled relative to vertical at a non-zero first angle such that the upper deflector extends over at least a portion of the outlet.

In some embodiments, the gas flue includes an internal deflector that extends into the cooling air passageway at a non-zero angle relative to horizontal.

Other embodiments of the invention are directed to a domestic cooking appliance for heating a food item. The domestic cooking appliance includes: a main housing having a rear wall; a cooking compartment in the main housing, the cooking compartment being configured to receive the food item to be heated; a gas burner that provides heat to the cooking compartment; a cooling air passageway located between the cooking compartment and the rear wall of the main housing, the cooling air passageway being separated from the cooking compartment by a rear wall of the cooking compartment; and a gas flue having an exhaust gas inlet open to the cooking chamber, the exhaust inlet being located in a lower panel of the gas flue, a cooling air inlet open to the cooling air passageway, an outlet located above the exhaust gas inlet, above the cooling air inlet, and above an uppermost portion of the cooking compartment, and an internal deflector that extends into the cooling air passageway.

In some embodiments, the internal deflector extends at a non-zero angle relative to horizontal.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic oven or other cooking appliance.

Figure 1:
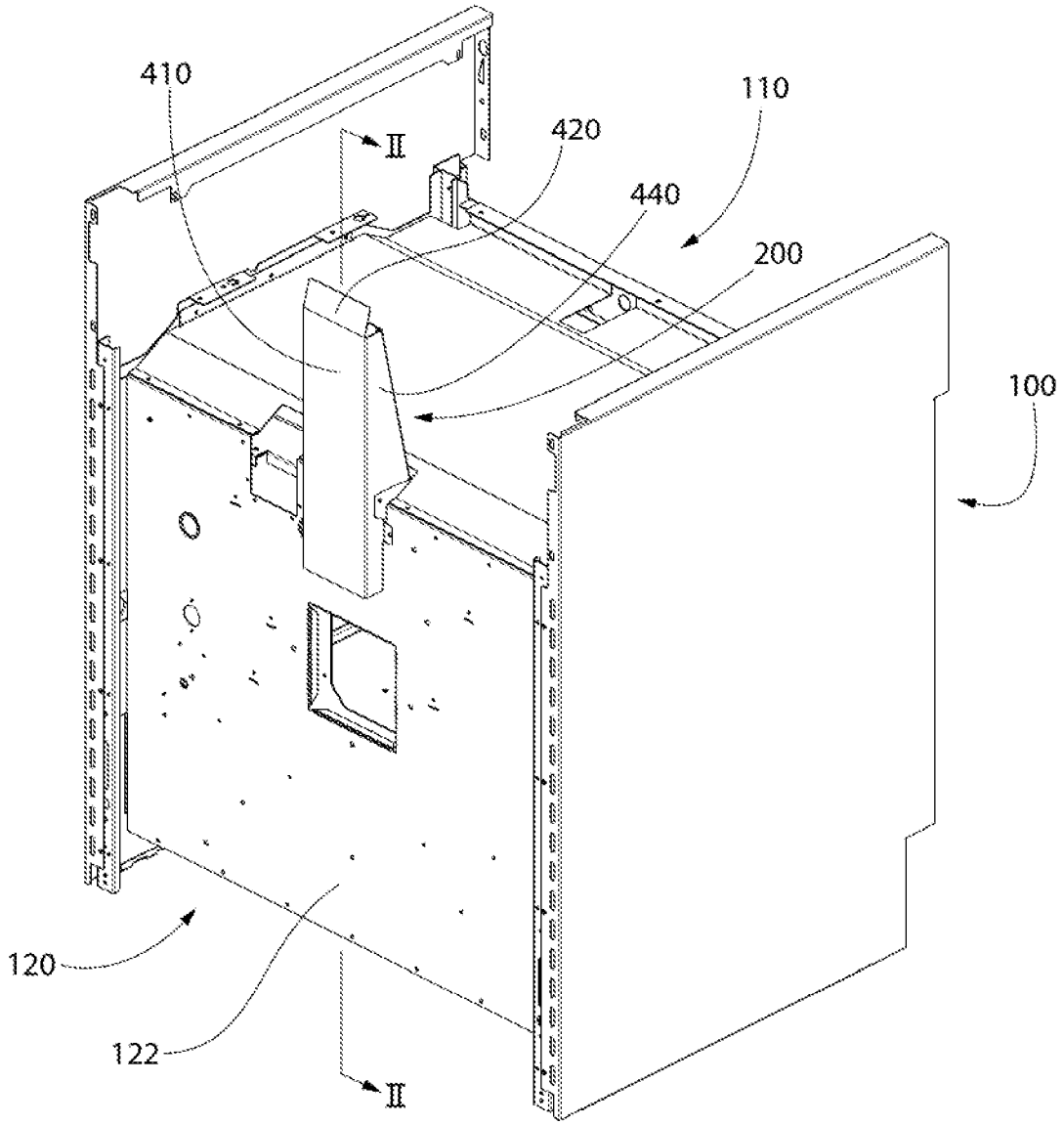
FIG. 1 is an upper rear perspective view of an exemplary appliance in accordance with embodiments of the invention.
Figure 2:
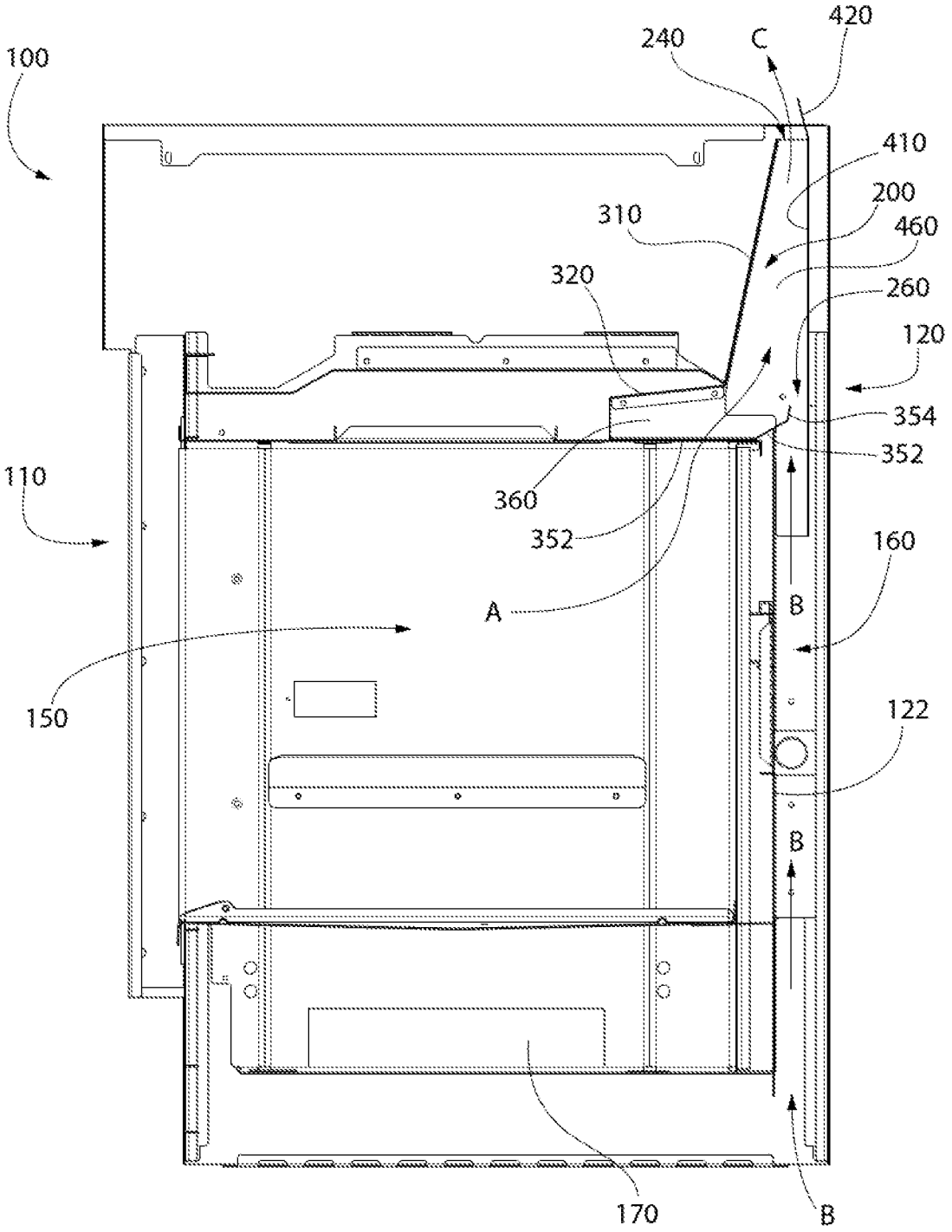
FIG. 2 is a side sectional view of the appliance shown in FIG. 1.

FIGS. 1 and 2 show an example of a gas cooking appliance 100 in accordance with embodiments of the invention. Examples of appliance 100 include ovens and ranges that burn natural gas, propane, and/or other gases to heat a food item. Appliance 100 has, in this example, a front 110 and a rear 120. Appliance 100 has a main housing and other features that have been omitted, either in whole of in part, for clarity. For example, in some embodiments, appliance 100 includes a cooktop, a second oven, and various other features. Appliance 100 has, in this example, a cooking compartment 150 that has a rear wall. In this example, a partition 122 is located between the rear wall of the cooking compartment and a rear exterior panel (omitted for clarity) of the main housing of appliance 100. Also shown is a gas flue 200 that directs exhaust gases from the cooking compartment 150 to an exterior of appliance 100.

As shown in FIG. 2, appliance 100 includes one or more burners 170 that burn a gas to provide heat to cooking compartment 150. The exhaust gases (represented by Arrow A) are vented from cooking compartment 150 through gas flue 200 and out to an exterior environment of appliance 100. A cooling air passageway 160 is formed between partition 122 and the rear exterior wall of the main housing of appliance 100. Other examples of the invention include a different routing of cooling air passage 160 and/or a different configuration of partition(s). A feature of cooling air passage 160 is that it routes cooling air from outside appliance 100 to gas flue 200.

As shown in FIG. 2, in this example, cooling air is drawn into the main housing of appliance 100 through one or more inlets at the lower area of the main housing and progresses upwards through cooling air passage 160 and into gas flue 200 (represented by Arrow B). Cooling air B is mixed with exhaust gases A in gas flue 200 to cool the exhaust gases and the mixed gases (Arrow C) are expelled from an outlet 240 of gas flue 200.

Figure 3:
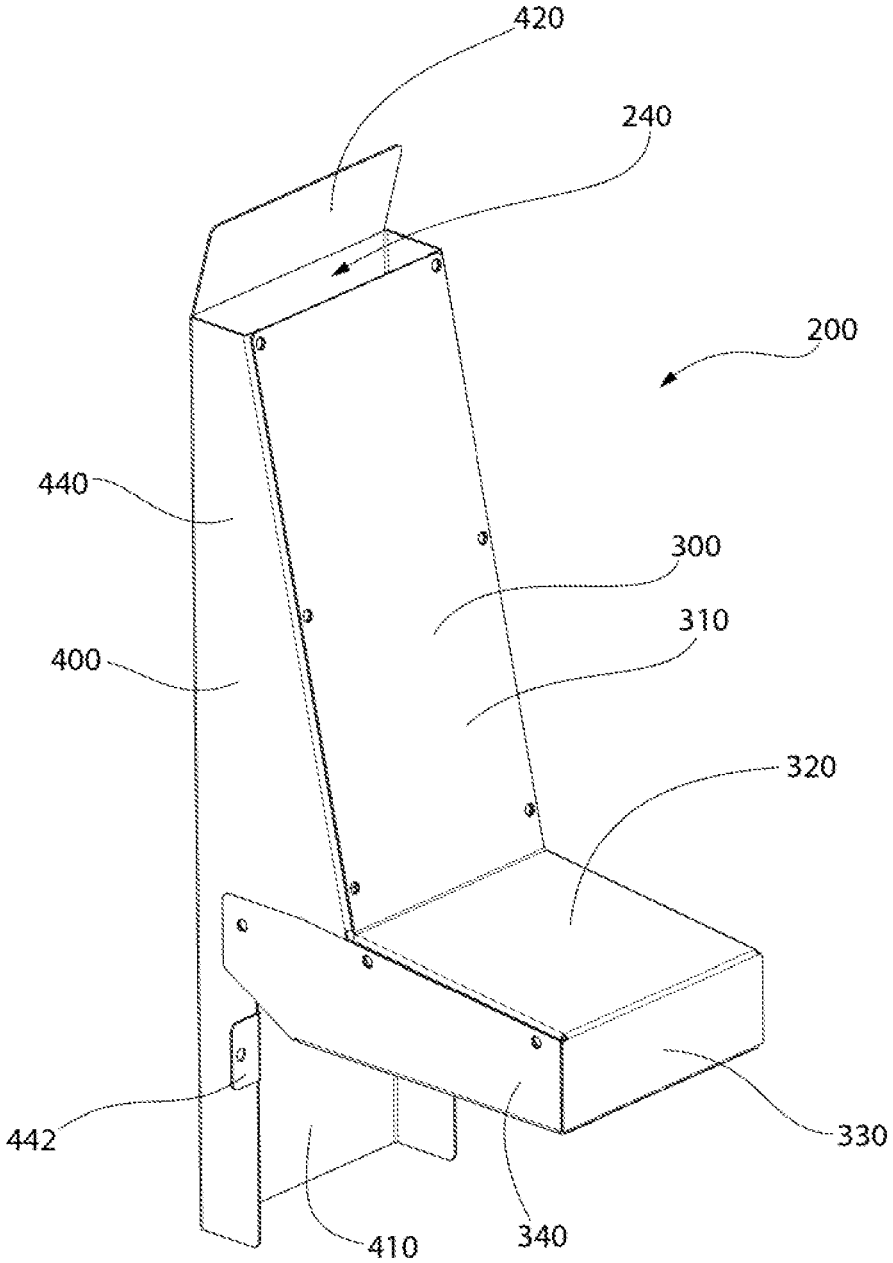
FIG. 3 is a perspective view of an exemplary gas flue in accordance with embodiments of the invention.
Figure 4:
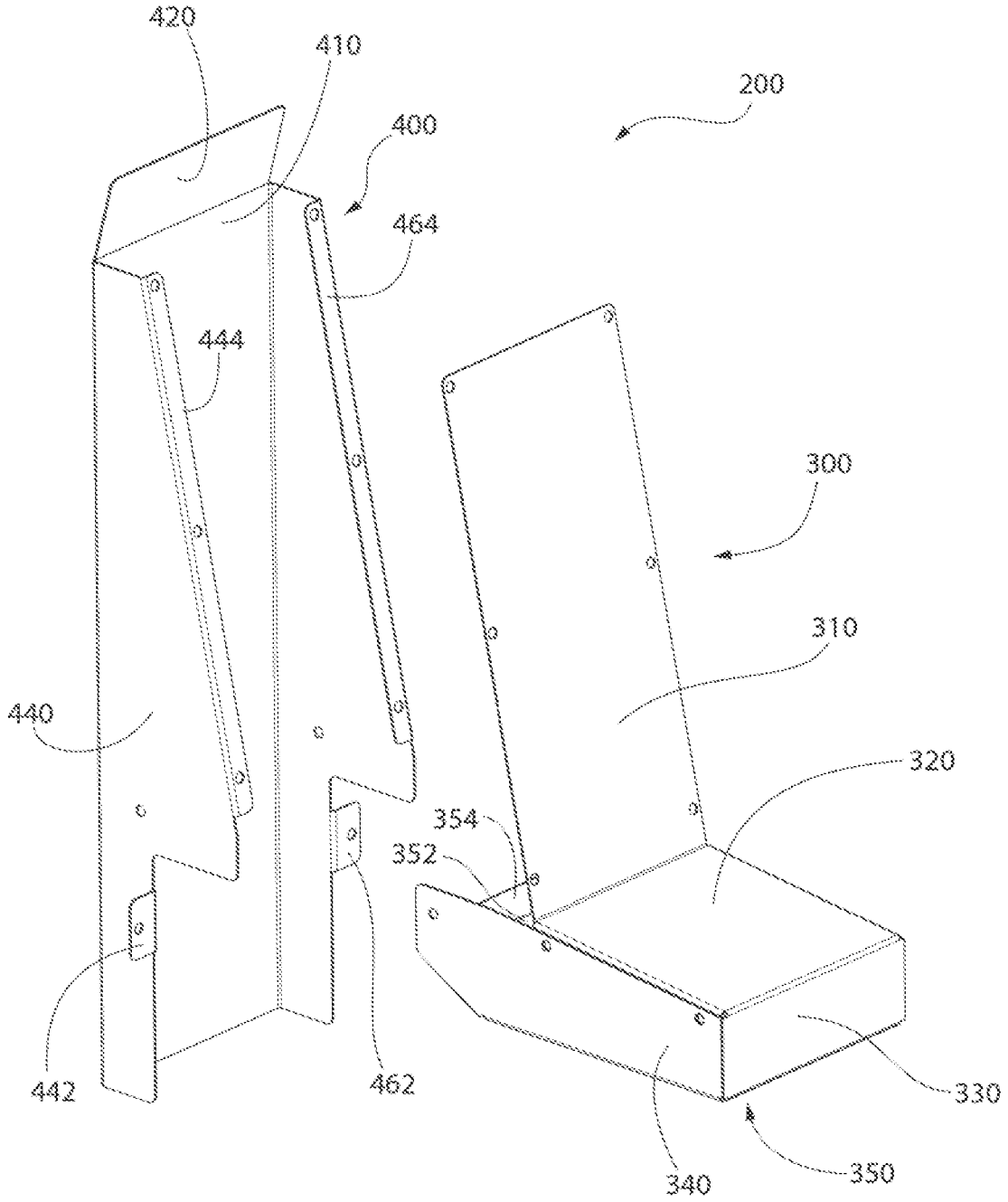
FIG. 4 is a perspective view of the gas flue shown in FIG. 3 in a disassembled state.

FIG. 3 shows an example of gas flue 200 in an assembled state and FIG. 4 shows this example of gas flue 200 in a disassembled state. In this example, gas flue 200 has a top section 300 and a rear section 400 that are attached to each other by, for example, screws, rivets, or another type of fastener. Gas flue 200 is made from, for example, stainless steel, some other metal, or some other heat resistant material. In this example, gas flue 200 is secured to appliance 100 with two rivets, screws, or other fasteners through tabs 442, 462 that protrude from side portions 440, 460 of rear portion 400, and with four rivets, screws or other fasteners through holes in a bottom panel 350 of top section 300 (shown in FIG. 10).

Figure 10:
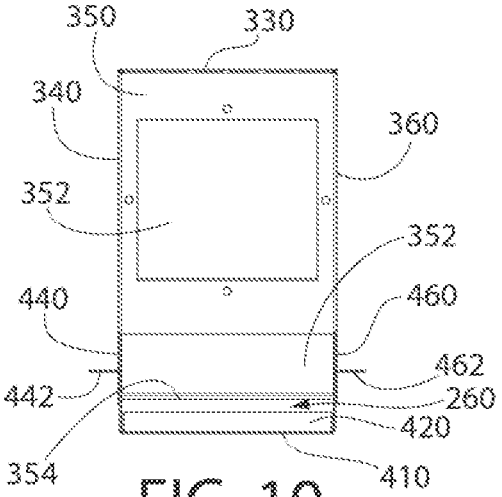
FIG. 10 is a bottom view of the gas flue shown in FIG. 3.

As shown in FIGS. 3 and 4, top section 300 has an upper angled panel 310 that shares a common edge with a lower angled panel 320. Lower angled panel 320 forms a box-like structure with a front panel 330, side panels 340, 360, and bottom panel 350. As shown in FIG. 10, bottom panel 350 has an exhaust inlet 352 that is, in this example, a rectangular opening in bottom panel 350. Exhaust inlet 352 is positioned over cooking compartment 150 and allows exhaust gases A to enter gas flue 200 (FIG. 2).

As shown in FIGS. 3 and 4, rear section 400 has a rear panel 410 that shares common edges with side panels 440, 460. Flanges 444, 464 are provided for attachment of top section 300 to rear section 400. Rear section 400 includes an upper deflector 420 that is angled relative to vertical and, in this example, relative to rear panel 410. Due to the angled position of upper deflector 420, upper deflector 420 extends over a portion of outlet 240 of gas flue 200 (FIG. 2). The angled nature of upper deflector 420 guides or deflects the flow of mixed gases C away from the rear of appliance 100 and toward the front of appliance 100.

Figure 5:
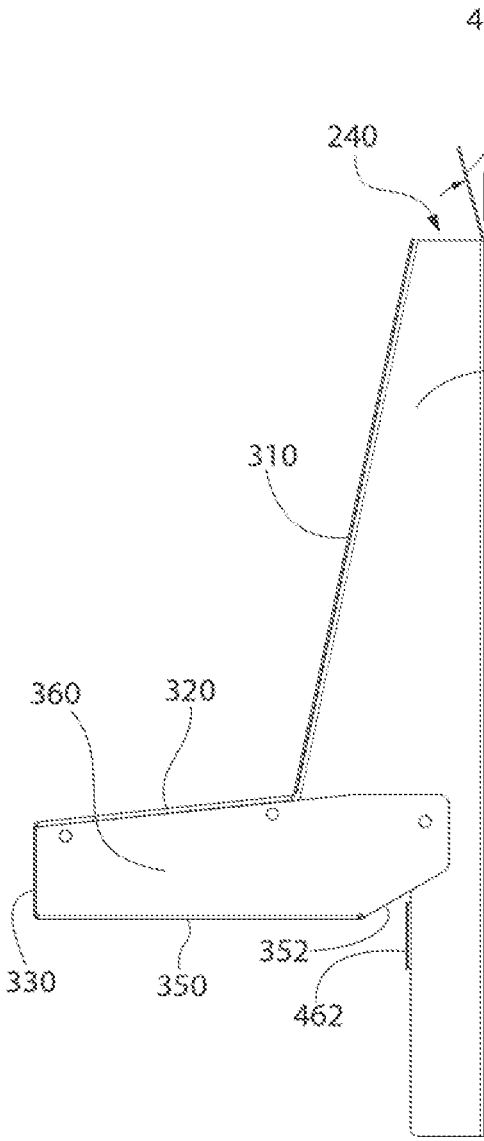
FIG. 5 is a side view of the gas flue shown in FIG. 3.
Figure 6:
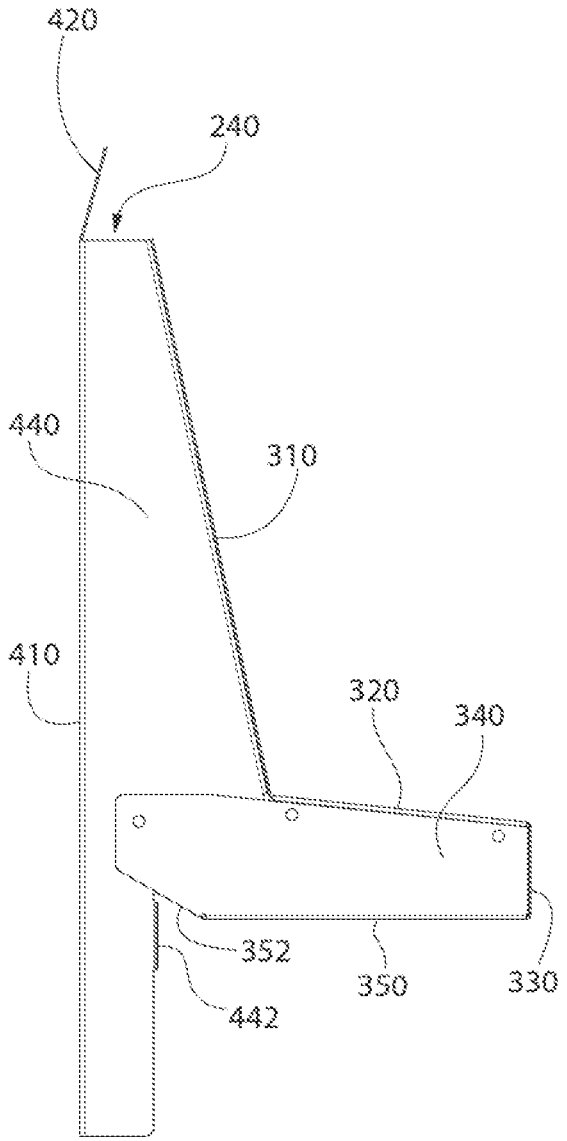
FIG. 6 is a side view of the gas flue shown in FIG. 3.

FIGS. 5 and 6 are side views of gas flue 200 in the assembled state of FIG. 3. The angle A which upper deflector 420 forms with vertical is shown in FIG. 5. Angle A is, for example, in the range of between 10 degrees and 20 degrees in order to sufficiently direct mixed gases C away from the rear of appliance 100 while not excessively restricting the flow of mixed gases C. In particular embodiments, Angle A is 15 degrees to most efficiently balance directing mixed gases C away from the rear of appliance 100 with minimizing the restriction of the flow of mixed gases C.

Figure 7:
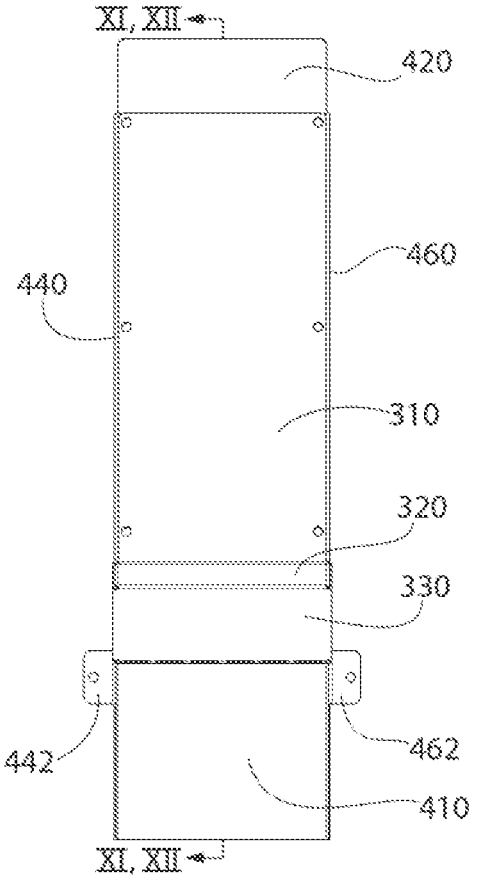
FIG. 7 front view of the gas flue shown in FIG. 3.
Figure 8:
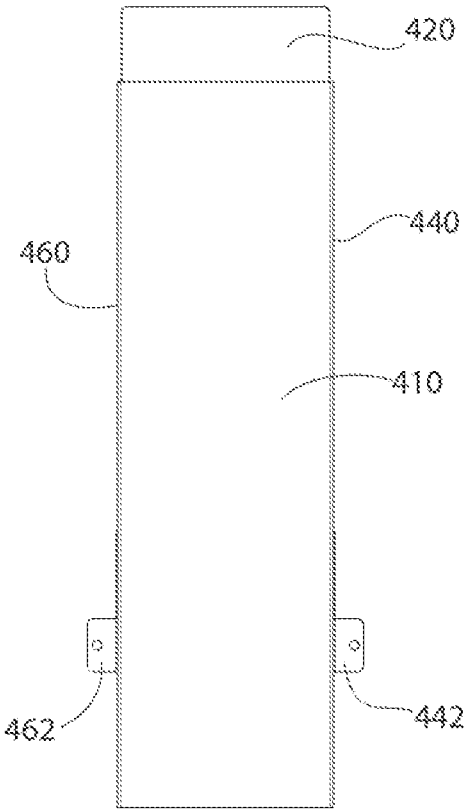
FIG. 8 is a rear view of the gas flue shown in FIG. 3.

FIG. 7 is a front view (as viewed from the front of appliance 100 when gas flue 200 is mounted to appliance 100) of gas flue 200. A portion of rear panel 410 of rear section 400 can be seen extending below front panel 330 of top section 300 (see also FIG. 3). Also seen in FIG. 7 is the sloping nature of lower angled panel 320 of top section 300 as seen from the front. FIG. 8 is a rear view of gas flue 200. The rear of upper deflector 420 can be seen in FIG. 8.

Figure 9:
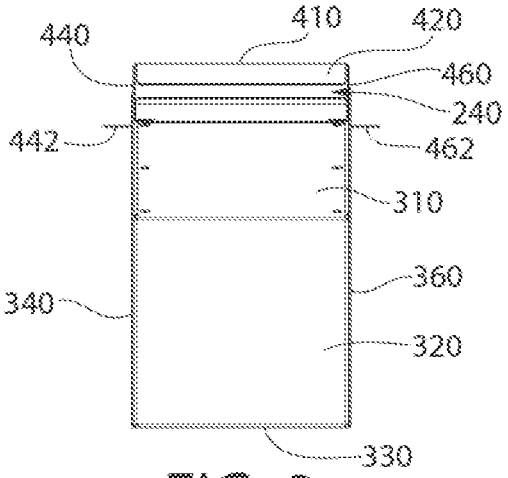
FIG. 9 is a top view of the gas flue shown in FIG. 3.

FIG. 9 is a top view of gas flue 200. As shown in FIG. 9, upper deflector 420 covers only a portion of outlet 240. FIG. 10 is a bottom view of gas flue 200 and shows exhaust inlet 352 in bottom panel 350 of front section 300. Also shown in FIG. 10 is a bottom view of upper deflector 420 and a small portion of outlet 240.

Figure 11:
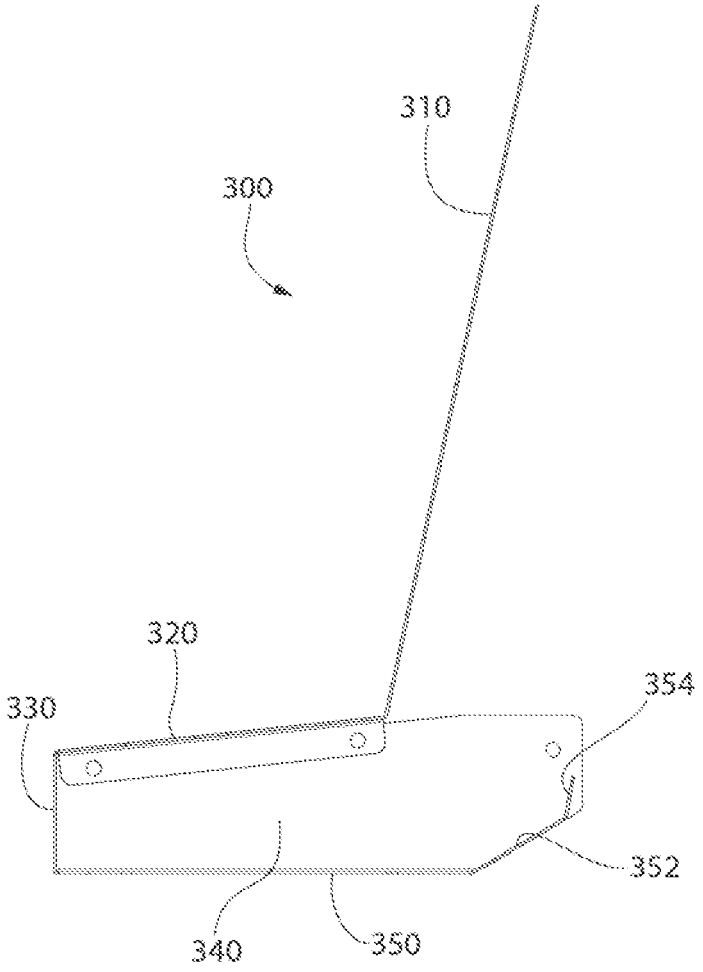
FIG. 11 is a sectional view of part of the gas flue shown in FIG. 3, taken along section line XI-XI in FIG. 7.
Figure 12:
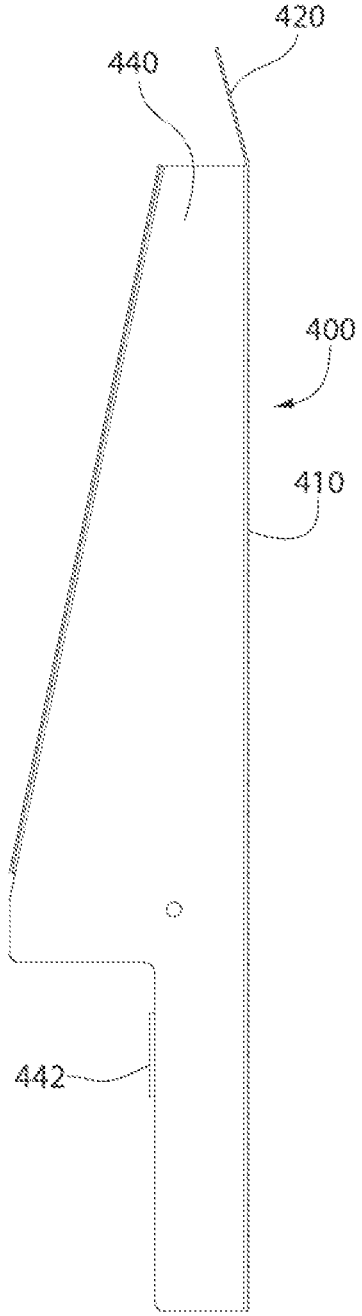
FIG. 12 is a sectional view of part of the gas flue shown in FIG. 3, taken along section line XII-XII in FIG. 7.

FIG. 11 is a sectional view of top section 300 of gas flue 200 taken along section line XI-XI in FIG. 7. FIG. 12 is a sectional view of rear section 400 of gas flue 200 taken along section line XII-XII in FIG. 7.

As shown in FIG. 11, top section 300 includes an internal deflector 352 that extends at an angle from bottom panel 350. Internal deflector 352 can also be seen in FIGS. 4-6 and, most clearly, 10. When mounted to appliance 100 as shown in FIG. 2, internal deflector 352 protrudes into cooling air passageway 160 to result in a cooling air inlet 260 that is narrower than a width of cooling air passageway 160. In embodiments, the cross-sectional area of cooling air inlet 260 is less than the cross-sectional area of cooling air passageway 160 immediately below cooling air inlet 260. This reduction in width and/or cross-section causes cooling air B to accelerate through cooling air inlet 260, which improves mixing with exhaust gases A. Internal deflector 352 also guides exhaust gases A upward in the direction of outlet 240. In embodiments, bottom panel 350 is horizontal when gas flue 200 is mounted to appliance 100. In embodiments, internal deflector 352 is at an angle in a range between 140 degrees and 160 degrees relative to horizontal. In particular embodiments, internal deflector 352 is at an angle of 150 degrees relative to horizontal to most efficiently balance accelerating cooling air B with resistance on the flow of cooling air B.

Also shown in FIG. 11 is an internal deflector extension 354 that extends at an angle from internal deflector 352. In the example shown, internal deflector extension 354 further reduces the width of cooling air inlet 260 and further guides exhaust gases A upward. In the example shown, internal deflector extension 354 is at an angle in a range between 120 degrees and 140 degrees relative to internal deflector 352. In particular embodiments, internal deflector extension 354 is at an angle of 130 degrees relative to internal deflector 352 to most efficiently balance accelerating cooling air B with resistance on the flow of cooling air B.

While particular angles are shown and described, it is noted that other angles are within the scope of embodiments of this invention.

In use, exhaust gases A from cooking compartment 150 enter gas flue 200 through rectangular exhaust inlet 352 in bottom panel 350 of top section 300. From that point, exhaust gases A naturally convect up through the upper area of gas flue 200, guided by internal deflector 352 and internal deflector extension 354. As hot exhaust gases A move past internal deflector 352 and internal deflector extension 354, they pull cooling air B from cooling air inlet 260 with them. This causes hot exhaust gases A to begin to cool. When gas mixture C reaches the top of gas flue (outlet 240) it is directed out and away from the rear wall (of the kitchen or other installation) that is behind appliance 100 by upper deflector 420. This helps to decrease the rear wall temperature and improve appliance safety.

Embodiments of the invention provide better cooking performance within cooking compartment 150 by allowing cooking compartment 150 to maintain a more stable temperature and also provide for better combustion results by the burners.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic cooking appliance for heating a food item, comprising:

a main housing having a rear wall;

a cooking compartment in the main housing, the cooking compartment being configured to receive the food item to be heated;

a gas burner that provides heat to the cooking compartment;

a cooling air passageway for drawing cooling air into the main housing, the cooling air passageway being located between the cooking compartment and the rear wall of the main housing and separated from the cooking compartment by a rear wall of the cooking compartment; and a gas flue having an exhaust gas inlet open to the cooking chamber for venting exhaust gasses, the exhaust inlet being located in a bottom panel of the gas flue, a cooling air inlet open to the cooling air passageway for drawing cooling air into the gas flue, wherein cooling air and exhaust gasses are mixed, an outlet located above the exhaust gas inlet, above the cooling air inlet, and above an uppermost portion of the cooking compartment, an upper deflector located above the outlet and angled relative to vertical at a non-zero first angle such that the upper deflector extends over at least a portion of the outlet, an internal deflector that extends into the cooling air passageway at a non-zero second angle relative to horizontal, the internal deflector having a first edge and a second edge, the first edge attached to the bottom panel of the gas flue such that the internal deflector extends from the bottom panel of the gas flue, and the second edge is opposite the first edge and extends into the cooling air passageway, wherein the bottom panel of the gas flue extends horizontally, a lower panel that extends at an angle relative to horizontal, which is different from the non-zero second angle, the lower panel being positioned opposite from the bottom panel, and an internal deflector extension having a first edge and a second edge, the first edge of the internal deflector extension is attached to the second edge of the internal deflector, the second edge of the internal deflector extension is opposite the first edge of the internal deflector, and the second edge of the internal deflector extension is non-coplanar with a plane defined by the first and second edges of the internal deflector.

2. The domestic cooking appliance of claim 1, wherein the internal deflector extension extends farther into the cooling air passageway than does the internal deflector.

3. The domestic cooking appliance of claim 2, wherein the internal deflector extension extends from the internal deflector at a third angle relative to horizontal, and the third angle is greater than the second angle.

4. The domestic cooking appliance of claim 3, wherein the gas flue further comprises a rear wall, and the cooling air inlet is a gap between the rear wall of the gas flue and the second edge of the internal deflector extension.

5. The domestic cooking appliance of claim 4, wherein the cooling air passageway has a width in a first direction from a front of the appliance to a rear of the appliance, the cooling air inlet has a width in the first direction, and the width of the cooling air inlet is less than the width of the cooling air passageway immediately below the cooling air inlet.

6. The domestic cooking appliance of claim 5, wherein the cooling air passageway extends from a bottom of the main housing to the cooling air inlet.

7. The domestic cooking appliance of claim 6, wherein the rear wall of the gas flue is separated by a gap from the rear wall of the main housing.

8. The domestic cooking appliance of claim 1, wherein the gas flue further comprises a rear wall, and the cooling air inlet is a gap between the rear wall of the gas flue and the second edge of the internal deflector.

9. The domestic cooking appliance of claim 8, wherein the cooling air passageway has a width in a first direction from a front of the appliance to a rear of the appliance, the cooling air inlet has a width in the first direction, and the width of the cooling air inlet is less than the width of the cooling air passageway immediately below the cooling air inlet.

10. A domestic cooking appliance for heating a food item, comprising:

a main housing having a rear wall;

a cooking compartment in the main housing, the cooking compartment being configured to receive the food item to be heated;

a gas burner that provides heat to the cooking compartment;

a cooling air passageway for drawing cooling air into the main housing, the cooling air passageway being located between the cooking compartment and the rear wall of the main housing, and separated from the cooking compartment by a rear wall of the cooking compartment; and a gas flue having an exhaust gas inlet open to the cooking chamber for venting exhaust gasses, the exhaust gas inlet being located in a bottom panel of the gas flue, a cooling air inlet open to the cooling air passageway for drawing cooling air into the gas flue, wherein cooling air and exhaust gasses are mixed, an outlet located above the exhaust gas inlet, above the cooling air inlet, and above an uppermost portion of the cooking compartment, an internal deflector that extends into the cooling air passageway, the internal deflector extending at a non-zero second angle relative to horizontal, the internal deflector having a first edge and a second edge, the first edge being attached to the bottom panel of the gas flue such that the internal deflector extends from the bottom panel of the gas flue, and the second edge is opposite the first edge and extends into the cooling air passageway, wherein the bottom panel extends horizontally, a lower panel that extends at an angle relative to horizontal, which is different from the non-zero second angle, the lower panel being positioned opposite from the bottom panel, and a rear wall, the cooling air inlet being a gap between the rear wall of the gas flue and the second edge of the internal deflector.

11. The domestic cooking appliance of claim 10, wherein the cooling air passageway has a width in a first direction from a front of the appliance to a rear of the appliance, the cooling air inlet has a width in the first direction, and the width of the cooling air inlet is less than the width of the cooling air passageway immediately below the cooling air inlet.

* * * * *